US011268327B2

(12) United States Patent
Al-Ghamdi et al.

(10) Patent No.: US 11,268,327 B2
(45) Date of Patent: Mar. 8, 2022

(54) WELLBORE CONDITIONING WITH A REAMER ON A WIRELINE

(71) Applicant: Saudi Arabian Oil Company, Dhahran (SA)

(72) Inventors: Muataz S. Al-Ghamdi, Dhahran (SA); Fahad M. Al-Yami, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 52 days.

(21) Appl. No.: 16/749,484

(22) Filed: Jan. 22, 2020

(65) Prior Publication Data

US 2021/0222496 A1 Jul. 22, 2021

(51) Int. Cl.

| | |
|---|---|
| ***E21B 10/32*** | (2006.01) |
| ***E21B 7/28*** | (2006.01) |
| ***E21B 49/00*** | (2006.01) |
| ***E21B 49/08*** | (2006.01) |

(52) U.S. Cl.

CPC ..... *E21B 10/322* (2013.01); *E21B 7/28* (2013.01); *E21B 49/00* (2013.01); *E21B 49/082* (2013.01)

(58) Field of Classification Search

CPC ..... E21B 10/322; E21B 7/28; E21B 49/00; E21B 49/082; E21B 31/125

See application file for complete search history.

(56) References Cited

U.S. PATENT DOCUMENTS

| | | | | |
|---|---|---|---|---|
| 2,609,878 | A | 9/1952 | Halliburton | |
| 2,915,123 | A | 12/1959 | Lebourg | |
| 4,350,204 | A * | 9/1982 | Horton | E21B 4/006 166/175 |
| 4,512,398 | A | 4/1985 | Hazel | |
| 4,766,955 | A | 8/1988 | Petermann | |
| 5,934,374 | A | 8/1999 | Hrametz et al. | |
| 7,036,611 | B2 | 5/2006 | Radford et al. | |
| 7,090,012 | B2 | 8/2006 | Hill et al. | |
| 7,341,117 | B2 | 3/2008 | Wylie et al. | |
| 7,377,317 | B2 | 5/2008 | Radzinski et al. | |
| 7,805,988 | B2 | 10/2010 | Kasperski et al. | |
| 9,284,784 | B2 | 3/2016 | Zaki et al. | |
| 2003/0019665 | A1 * | 1/2003 | Horton | E21B 4/06 175/293 |
| 2006/0225880 | A1 * | 10/2006 | Radzinski | E21B 47/017 166/250.01 |
| 2010/0064794 | A1 | 3/2010 | Jackson et al. | |

(Continued)

OTHER PUBLICATIONS

PCT Invitation to Pay Additional Fees and, Where Applicable, Protest Fee in International Appln. No. PCT/US2021/014316, dated Apr. 8, 2021, 13 pages.

(Continued)

*Primary Examiner* — David Carroll
(74) *Attorney, Agent, or Firm* — Fish & Richardson P.C.

(57) ABSTRACT

To condition a wellbore with a reamer on a wireline, a portion of a wellbore is formed from a surface of the earth toward a subsurface hydrocarbon reservoir using a wellbore drilling assembly. After forming the portion of the wellbore, the wellbore drilling assembly is removed from the portion of the wellbore. Using a wireline, a wellbore sampling tool and a reamer are lowered into the portion of the wellbore. While maintaining the wellbore sampling tool and the wireline in a non-rotational state, the portion of the wellbore is cleaned using the reamer.

23 Claims, 8 Drawing Sheets

(56) References Cited

U.S. PATENT DOCUMENTS

| | | | | |
|---|---|---|---|---|
| 2010/0282511 | A1* | 11/2010 | Maranuk | E21B 47/08 175/40 |
| 2014/0196532 | A1 | 7/2014 | Bullock et al. | |
| 2015/0176405 | A1 | 6/2015 | Corre et al. | |
| 2015/0226009 | A1 | 8/2015 | Claudey et al. | |

OTHER PUBLICATIONS

PCT International Search Report and Written Opinion in International Appln. No. PCT/US2021/014316, dated Jun. 1, 2021, 18 pages.

* cited by examiner

WELLBORE CONDITIONING WITH A REAMER ON A WIRELINE

TECHNICAL FIELD

This disclosure relates to wellbore operations, for example, wellbore conditioning operations and sampling or logging data describing wellbores.

BACKGROUND

Hydrocarbons trapped in subsurface hydrocarbon reservoirs can be produced (that is, raised to the surface) through wellbores formed in subterranean zones extending from a surface of the Earth to the hydrocarbon reservoirs. A subsurface hydrocarbon reservoir is periodically evaluated, for example, prior to or during wellbore formation, during hydrocarbon production, or at other times. Reservoir evaluation and management can affect wellbore development plans as well as placement. One technique to evaluate the reservoir is to sample well data (for example, wellbore fluids, reservoir rock samples) from within the wellbore. Logging while drilling (LWD) tools and measuring while drilling (MWD) tools are examples of tools that can be used to sample well data. In operation, such a tool is lowered into the wellbore, for example, on a wireline, to sample the well data.

SUMMARY

This disclosure describes technologies relating to wellbore conditioning with a reamer on a wireline. Certain aspects of the subject matter described here can be implemented as a method. Using a wellbore drilling assembly, a portion of a wellbore is formed from a surface of the earth toward a subsurface hydrocarbon reservoir. After forming the portion of the wellbore, the wellbore drilling assembly is removed from the portion of the wellbore. Using a wireline, a wellbore sampling tool, and a reamer are lowered into the portion of the wellbore. While maintaining the wellbore sampling tool and the wireline in a non-rotational state, the portion of the wellbore is cleaned using the reamer.

An aspect that can be combined with any of the other aspects, includes the following features. Maintaining the wellbore sampling tool and the wireline in a non-rotational state includes not rotating the wellbore sampling tool and the wireline within the portion of the wellbore.

An aspect that can be combined with any of the other aspects, includes the following features. While maintaining the wellbore sampling tool and the wireline in a non-rotational state, using the reamer to ream the portion of the wellbore includes reciprocating the wireline within the portion of the wellbore. The reamer reams the portion of the wellbore responsive to reciprocating the wireline.

An aspect that can be combined with any of the other aspects, includes the following features. Reciprocating the wireline within the portion of the wellbore includes causing the reamer to alternatingly travel uphole and downhole within the portion of the wellbore.

An aspect that can be combined with any of the other aspects, includes the following features. The reamer includes multiple reaming pads on an outer surface of the reamer. The multiple reaming pads are configured to contact an inner wall of the portion of the wellbore. Using the reamer, reaming the portion of the wellbore includes causing the multiple reaming pads to contact the inner wall of the portion of the wellbore.

An aspect that can be combined with any of the other aspects, includes the following features. The multiple reaming pads are in a retracted state when the wireline is used, to lower the wellbore sampling tool and the reamer into the portion of the wellbore. The multiple reaming pads are extended from the retracted state into an extended state. The multiple reaming pads contact the inner wall of the portion of the wellbore in the extended state.

An aspect that can be combined with any of the other aspects, includes the following features. To the wireline, an electrical signal is transmitted from the surface of the earth to the reamer. Responsive to the electrical signal, the reamer extends the multiple reaming pads from the retracted state into the extended state.

An aspect that can be combined with any of the other aspects, includes the following features. A hydraulic fluid reservoir is attached to the reamer. Responsive to the electric signal, hydraulic fluid in the hydraulic fluid reservoir is flowed to the multiple reaming pads to extend the multiple reaming pads from the retracted state into the extended state.

An aspect that can be combined with any of the other aspects, includes the following features. A hydraulic piston is attached to each reaming pad of the multiple reaming pads and to the hydraulic fluid reservoir. Flowing the hydraulic fluid to each reaming pad causes the corresponding hydraulic piston to extend.

An aspect that can be combined with any of the other aspects, includes the following features. Responsive to reciprocating the wireline, the reamer reams the portion of the wellbore without rotating within the portion of the wellbore.

An aspect that can be combined with any of the other aspects, includes the following features. Responsive to reciprocating the wireline, the reamer rotates about a longitudinal axis of the wellbore to ream the portion of the wellbore.

An aspect that can be combined with any of the other aspects, includes the following features. The reamer is connected to the wireline using one or more wireline swivels. The one or more wireline swivels cause the reamer to rotate about the longitudinal axis of the wellbore responsive to reciprocating the wireline within the portion of the wellbore.

An aspect that can be combined with any of the other aspects, includes the following features. After reaming the portion of the wellbore, the wellbore sampling tool is operated to sample data associated with the wellbore.

Certain aspects of the subject matter described here can be implemented as a method. After forming a portion of a wellbore from a surface of the earth toward a subsurface hydrocarbon reservoir, a well tool assembly including a wellbore sampling tool and a reamer is lowered into the portion of the wellbore. The reamer is attached to the wireline downhole of the wellbore sampling tool. Without rotating the wireline or the wellbore sampling tool, the portion of the wellbore is reamed using the reamer. After reaming the portion of the wellbore, data associated with the wellbore is sampled using the wellbore sampling tool.

An aspect that can be combined with any of the other aspects, includes the following features. Without rotating the wireline or the wellbore sampling tool, using the reamer to ream the portion of the wellbore includes reciprocating the wireline within the portion of the wellbore. The reamer reams the portion of the wellbore responsive to reciprocating the wireline.

An aspect that can be combined with any of the other aspects, includes the following features. Reciprocating the wireline within the portion of the wellbore includes causing the reamer to alternatingly travel uphole and downhole within the portion of the wellbore.

An aspect that can be combined with any of the other aspects, includes the following features. Responsive to reciprocating the wellbore, the reamer reams the portion of the wellbore without rotating within the portion of the wellbore.

An aspect that can be combined with any of the other aspects, includes the following features. Responsive to reciprocating the wireline, the reamer rotates about the longitudinal axis of the wellbore to ream the portion of the wellbore.

An aspect that can be combined with any of the other aspects, includes the following features. The wellbore tool assembly includes a wireline swivel that connects the reamer to the wireline. The reamer rotates about the swivel responsive to reciprocating the wireline.

An aspect that can be combined with any of the other aspects, includes the following features. The reamer is in a retracted state when the well tool assembly is lowered into the portion of the wellbore. In the retracted state, the reamer does not contact an inner wall of the portion of the wellbore. From the surface of the Earth and through the wireline, an electrical signal is transmitted to the reamer. Responsive to the electrical signal, the reamer is transformed to an extended state. In the extended state, the reamer contacts the inner wall of the portion of the wellbore.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes a downhole reaming system that can be used in conjunction with wireline operations such as logging or fluid sampling. By implementing the downhole reamers described in this disclosure, a portion of the wellbore can be conditioned prior to logging or fluid sampling. In particular, by mounting the logging or fluid sampling tool (for example, the LWD tool) or both and the reamer on the same wireline that is used for electric logging operations, the wellbore conditioning and the well data sampling operations can be performed in the same trip. In this manner, a trip separately dedicated to wellbore conditioning prior to well data sampling can be avoided. Consequently, wellbore evaluation time can be decreased, and potential downhole problems such as sticking can be avoided. Overall, implementing the techniques described here can help to improve the cost efficiency of logging and sampling operations.

Figure 1A:
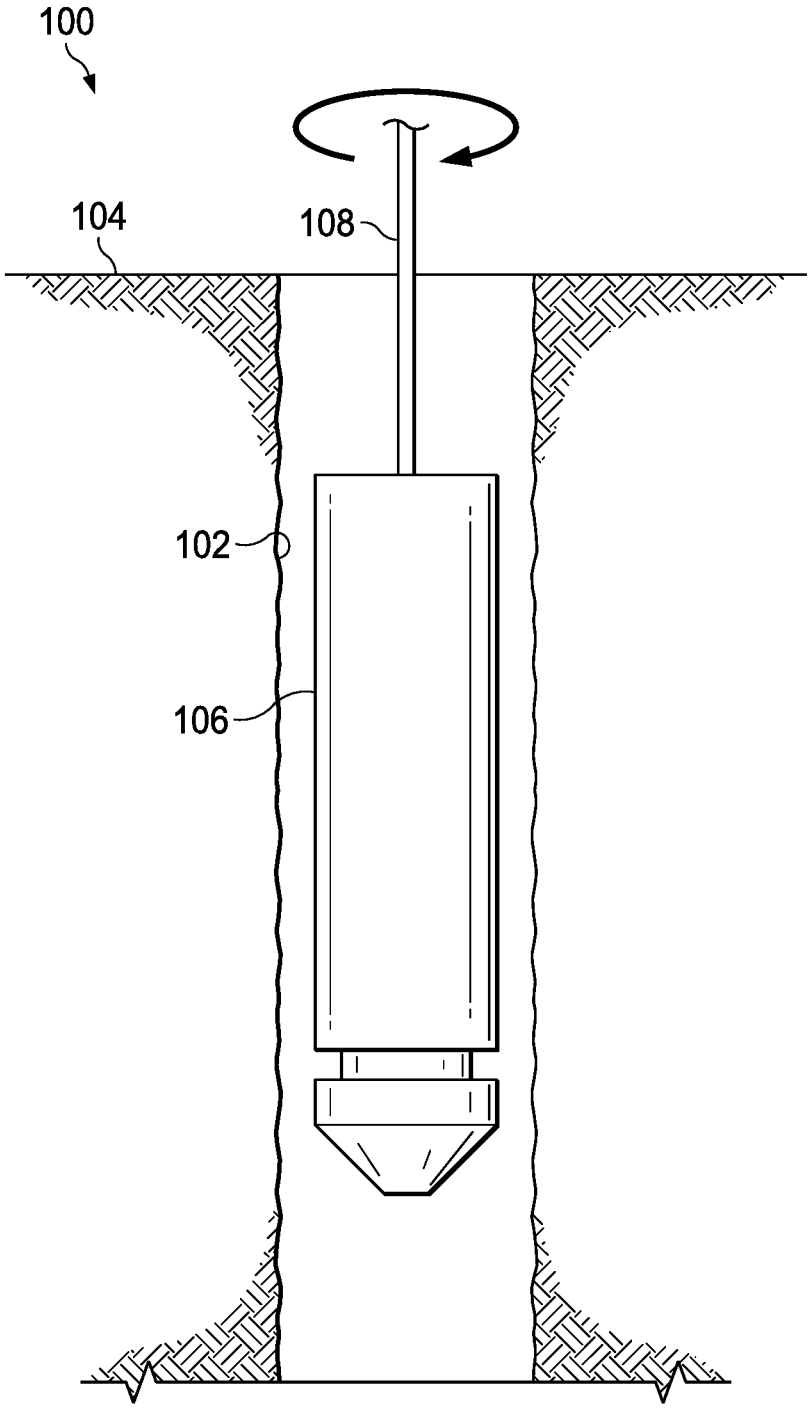
FIG. 1A is a schematic diagram of the wellbore drilling assembly drilling a wellbore.

FIG. 1A is a schematic diagram of the wellbore drilling assembly drilling a wellbore. The subterranean zone 100 includes a subsurface hydrocarbon reservoir (not shown) in which hydrocarbons are entrapped. A wellbore 102 is drilled from a surface 104 of the Earth towards the subsurface hydrocarbon reservoir. For example, a wellbore drilling assembly 106, which includes a drill string and a drill bit, is used to drill the wellbore in the subterranean zone 100. In operation, the wellbore drill assembly is driven through the subterranean zone 100 using a drill string 108 which is rotated to rotate the wellbore drill assembly. The well operations described in this disclosure, which include wellbore conditioning and well data sampling, can be implemented in the wellbore 102. In some instances, the well operations can be implemented after the wellbore has been formed in its entirety. In some instances, the well operations can be implemented after only a portion of the wellbore has been formed. In such instances, the well operations can be implemented multiple times as additional portions of the wellbore are being formed.

Figure 1B:
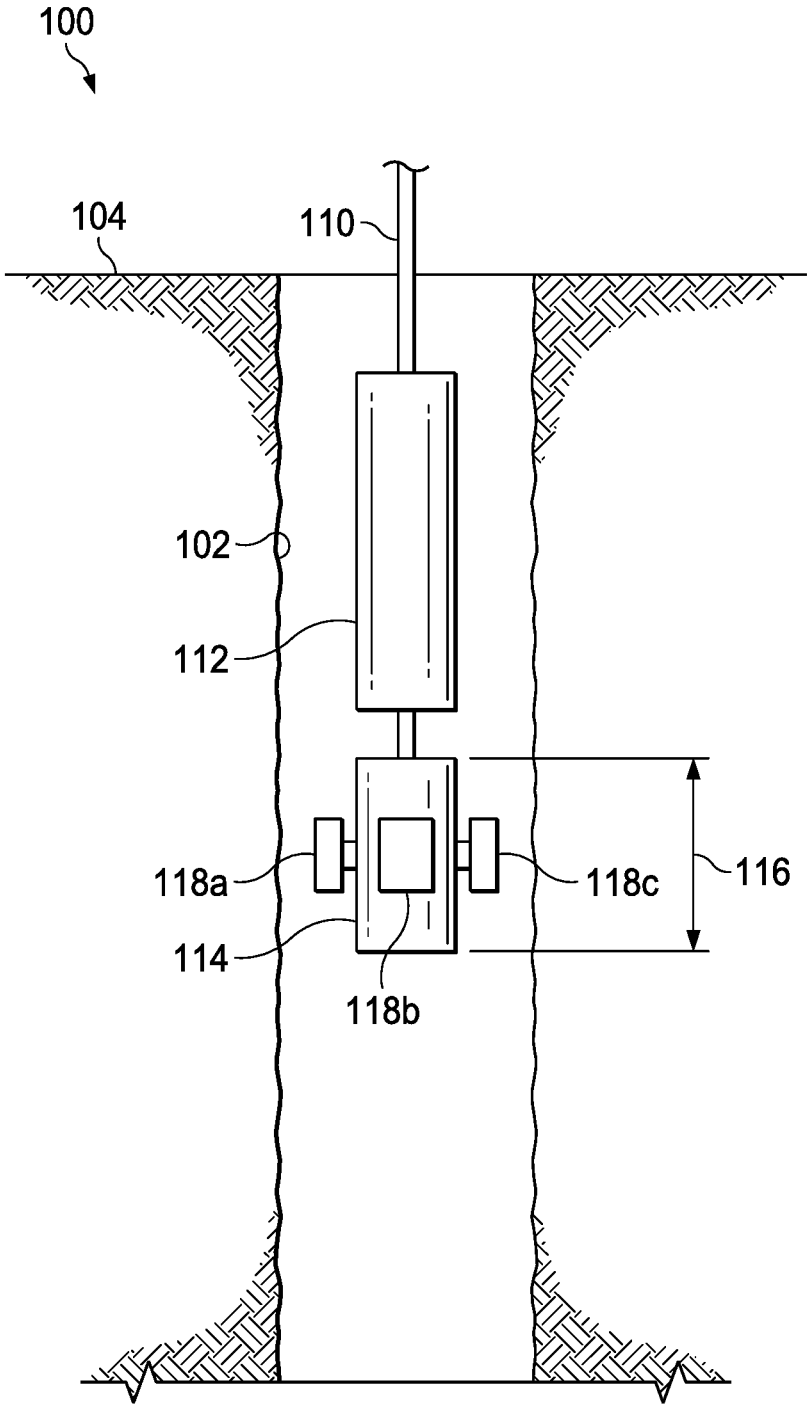
FIG. 1B is an example of a well tool assembly including a reamer being lowered into the wellbore of FIG. 1A.

FIG. 1B is an example of a well tool assembly including a reamer being lowered into the wellbore 102. After forming the portion of the wellbore 102, the wellbore drilling assembly 106 is removed from within the portion of wellbore 102. Subsequently, a well tool assembly is lowered into the portion of wellbore 102 using a wireline 110. To do so, the wireline 110 is attached to the well tool assembly at the surface 104. The wireline 110 is capable of supporting at least a weight of the well tool assembly. The wireline 110 is also capable of carrying electrical or data signals (or both) from the surface 104 to each component of the well tool assembly. The wireline 110 can be a single-strand or multi-strand wire or cable for intervention in oil or gas wells. The thickness and maximum wireline pulling capacity can be determined based on weight of the logging tool. In application, the wireline 110 can be either a pipe-conveyed wireline tool string for complex well profile or heavy duty wireline.

The well tool assembly includes a wellbore sampling tool 112 (for example, an LWD tool or other well sampling tool) and a reamer 114. As described later, the reamer 114 is used to condition an interval 116 within the wellbore 102 while maintaining the wellbore sampling tool 112 in a non-rotational state. By "non-rotational," it is meant that neither the wireline 110 nor the wellbore sampling tool 112 rotate within the portion of the wellbore 102 about a longitudinal axis of the portion of the wellbore 102 while the reamer 114 conditions an inner wall of the interval 116. However, the reamer 114 is free to rotate about the longitudinal axis of the portion of the wellbore 102 even when the wireline 110 or the wellbore sampling tool 112 is in a non-rotational state. With this arrangement, the reamer 114 is rotated within the wellbore 102 by reciprocation of the wireline 110 or the wellbore sampling tool 112.

The reamer 114 includes a reamer body. In some implementations, the reamer 114 includes reamer pads (for example, reamer pads 118*a*, 118*b*, 118*c*) attached to an outer surface of the reamer body. The number of reamer pads can vary. For example, the reamer 114 can include 4 reamer pads spaced 90° apart on the outer surface of the reamer body. In another example, the reamer 114 can include one annular reamer pad through which the reamer body passes. In some implementations the reamer pads can be spiral blades covered by an abrasive material such as tungsten carbide. When the reamer pads contact the inner wall of the wellbore 102, the pads ream or condition a desired interval (for example, the interval 116) of the wellbore 102.

Figure 1C:
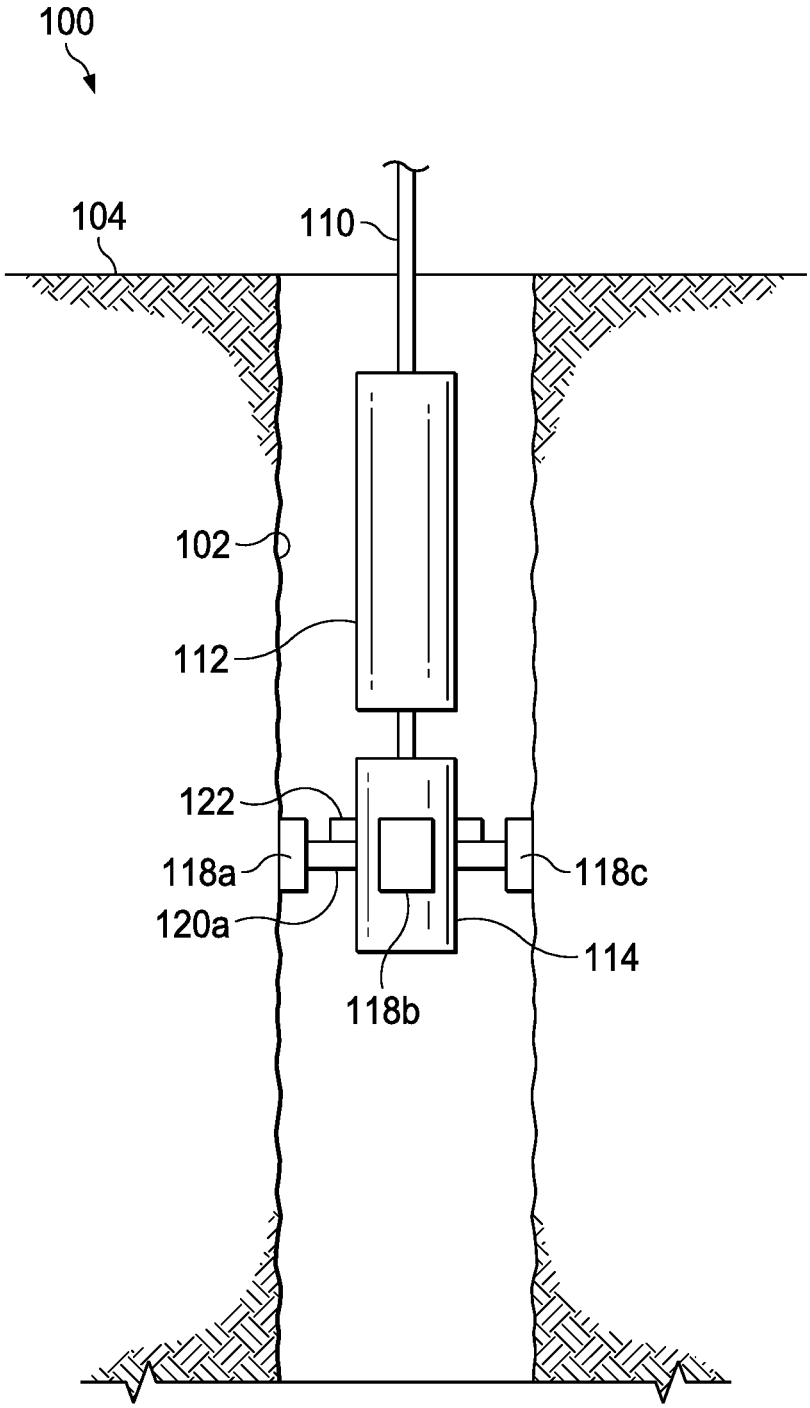
FIG. 1C is an example of the reamer being deployed in the wellbore.

FIG. 1C is an example of the reamer 114 being deployed in the wellbore 102. When lowered into the portion of the wellbore 102, the reamer 114 is in a retracted state. In the retracted state, the reamer pads are nearer to the reamer body such that the combined outer diameter of the reamer pads and the reamer body is less than an inner diameter of the inner wall of the portion of the wellbore 102. Consequently, in the retracted state, the wireline 110 can lower the reamer 114 into the portion of the wellbore 102 without the reamer 114 interfering with the inner wall of the wellbore 102. Upon reaching a desired depth, for example, the depth of the interval 116, the reamer 114 can be deployed from the retracted state to an extended state. In the extended state, the reamer pads can be extended radially away from the reamer body. To do so, in some implementations, the reamer 114 can include a hydraulic piston (for example, piston 120*a*) for each reamer pad. The reamer 114 can also include a hydraulic fluid reservoir 122. In operation, an electrical signal can be sent downhole from the surface 104 through the wireline 110 to the hydraulic fluid reservoir 122. In response, the hydraulic fluid reservoir 122 can pump the hydraulic fluid to each hydraulic piston connected to each reamer pad. Responsively, each hydraulic piston can extend thereby extending each reamer pad radially away from the reamer body. In this manner, the reamer pads can be extended to contact the inner wall of the wellbore 102. When all the reamer pads contact the inner wall of the wellbore 102, the reamer 114 is in the extended state and has been deployed.

Figure 1D:
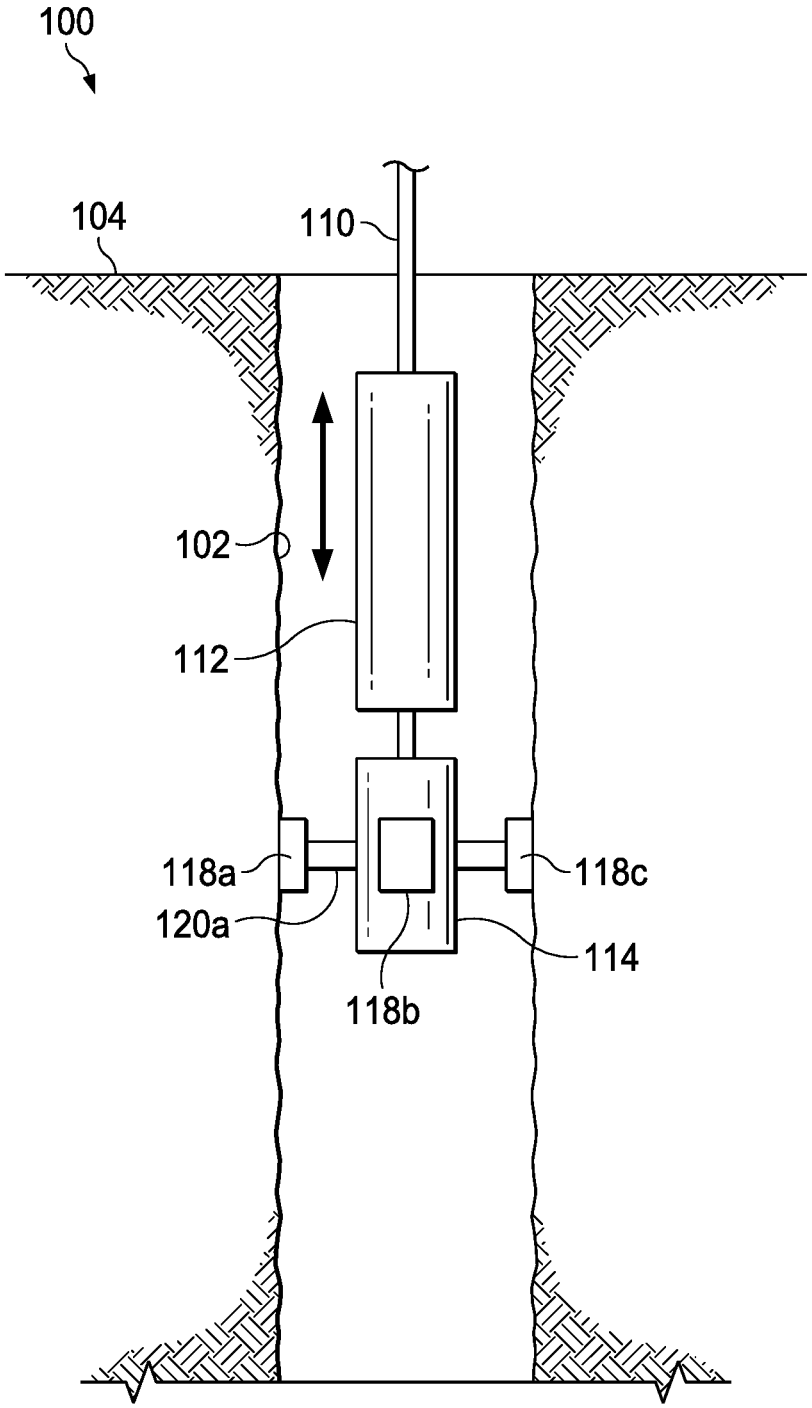
FIG. 1D is an example of the well tool assembly reciprocating within the wellbore.

FIG. 1D is an example of the well tool assembly reciprocating within the wellbore 102. As described earlier, the wireline 110 and the wellbore sampling tool 112 are in a non-rotational state when the reamer 114 is deployed to its extended state. In this configuration, an over pull operation can be implemented to condition the interval 116. In some implementations, the wireline 110 can be alternatingly reciprocated in an uphole and downhole direction along the longitudinal axis of the portion of the wellbore 102. In some implementations, the wireline 110 is pulled in the uphole direction for wireline conveyed tool string and lowered in the downhole direction for pipe-conveyed wireline tool string. Because the reamer pads contact the inner wall of the wellbore 102, the alternating reciprocating motion causes the reamer 114 to condition, that is, ream, the inner wall of the interval 116. In this implementation, the reamer 114 conditions the inner wall of the portion of the wellbore 102 without rotating within the portion of the wellbore 102.

Figure 1E:
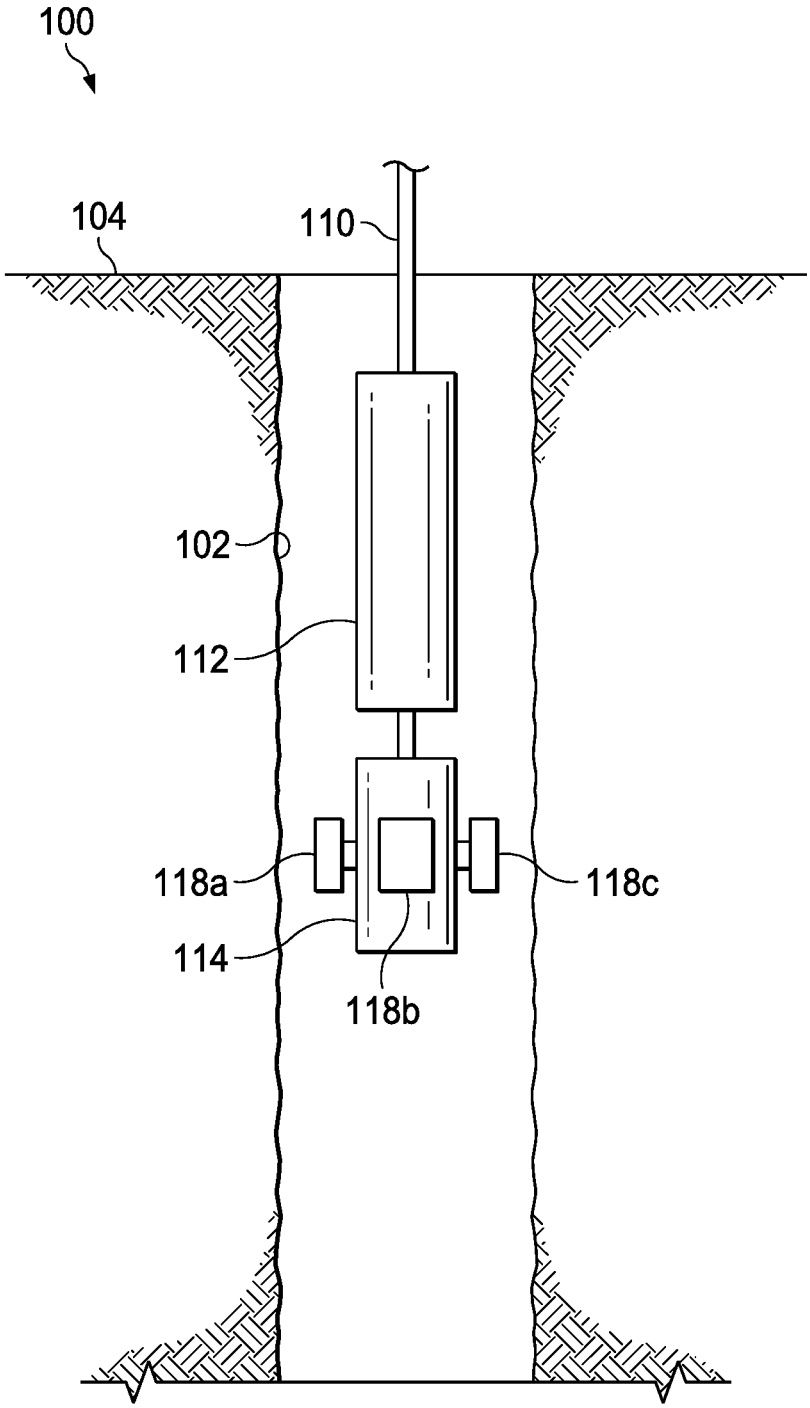
FIG. 1E is an example of the reamer being retracted within the wellbore.
Figure 1F:
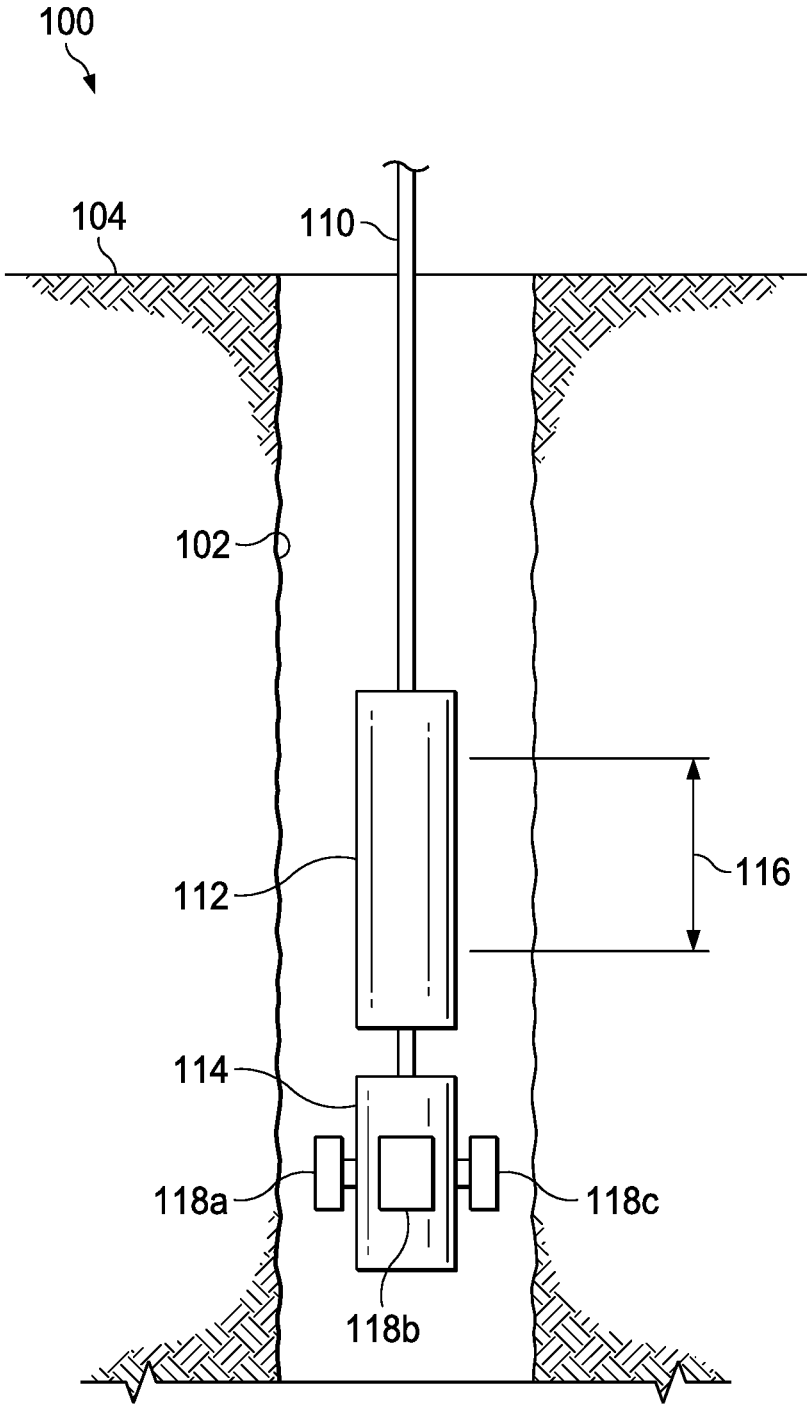
FIG. 1F is an example of a LWD tool sampling data while within the wellbore.

FIG. 1E is an example of the reamer 114 being retracted within the wellbore 102. After the reamer 114 has conditioned the inner wall of the portion of the wellbore 102, the reamer 114 is transitioned from the extended state to the retracted state. FIG. 1F is an example of a LWD tool sampling data while within the wellbore 102. With the reamer 114 in the retracted state, the wireline 110 is lowered further into the portion of the wellbore 102 until the wellbore sampling tool 112 is at the depth of the conditioned section of the portion of the wellbore 102, that is, the interval 116. At this depth, the wellbore sampling tool 112 is operated to sample data associated with the wellbore 102. For example, the wellbore sampling tool 112 is operated to collect fluid samples, reservoir rock samples, or both at the conditioned interval 116. The wellbore sampling tool 112 is operated to collect the samples at specific intervals by opening modular probes and storing the samples in the chamber while pressure testing tools record reservoir pressure.

Figure 1G:
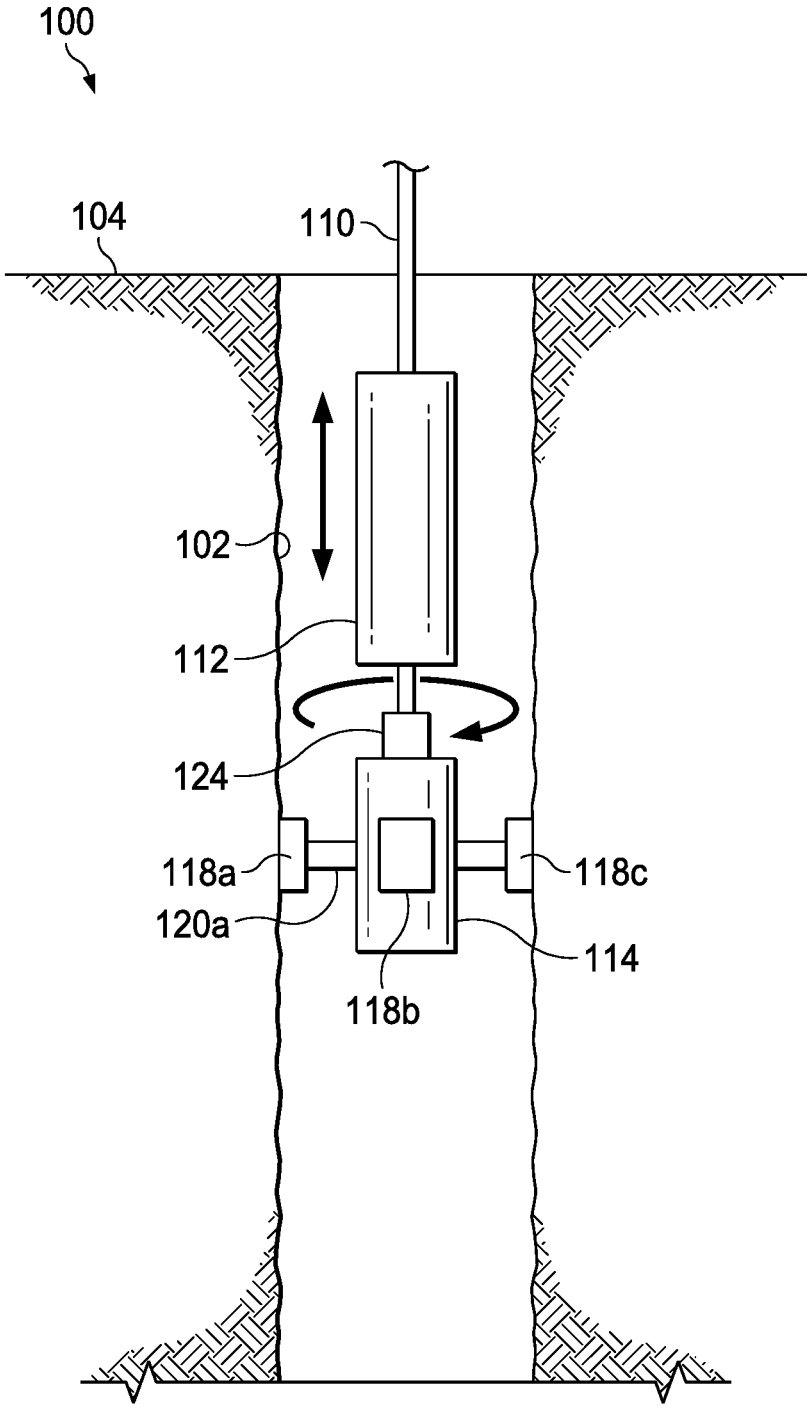
FIG. 1G is an example of the reamer rotating within the wellbore.

FIG. 1G is an example of the reamer 114 rotating within the wellbore 102. In the implementation described earlier, the reamer 114 was in the same non-rotational state as the wireline 110 and the wellbore sampling tool 112. That is, the reamer 114 did not rotate about the longitudinal axis of the portion of the wellbore 102 to condition the interval 116. In some implementations, the reamer 114 rotates about the longitudinal axis of the portion of the wellbore 102 to condition the interval 116 while the wireline 110 and the wellbore sampling tool 112 remain in the non-rotational state. Such an implementation is schematically shown in FIG. 1G. In such implementations, a swivel 124 couples the reamer 114 to the wireline 110. As the wireline 110 reciprocates within the portion of the wellbore 102, the swivel 124 converts the reciprocating motion into a rotation of the reamer 114. The rotating reamer 114 conditions the interval 116. In some implementations, the wireline deployed tool can be modified to rotate on pulling the tool string in the uphole direction, while in other implementations, the drill pipe conveyed wireline can rotate the reamer on reciprocation of the string. In some implementations, only pulling the tool string in the uphole direction causes the reamer to rotate and perform the reaming operation. In such implementations, the reamer does not rotate or perform the reaming operation when the tool is lowered into the wellbore. Thus, in such implementations, while the reamer is reciprocated within the wellbore, the reaming operation happens only when the tool string is being pulled in the uphole direction.

Figure 2:
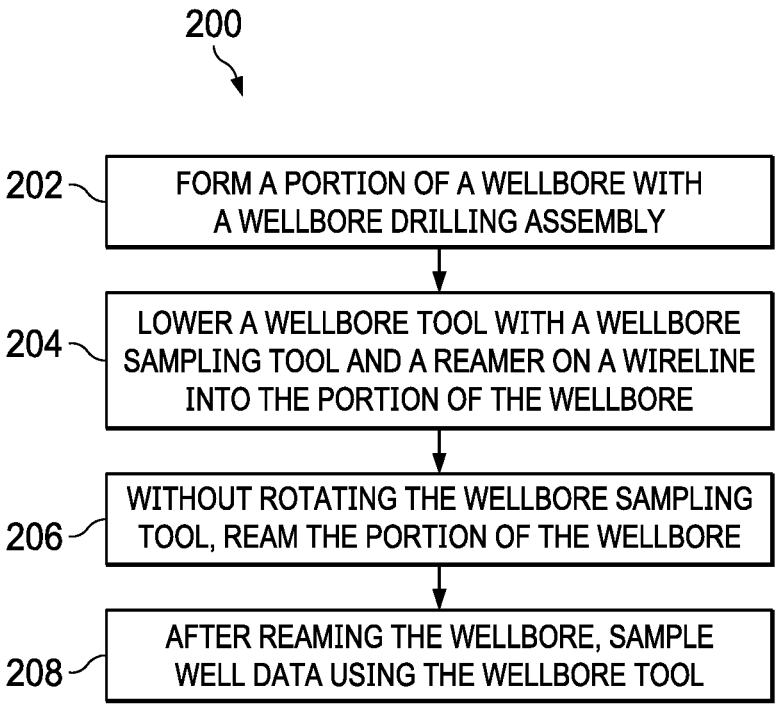
FIG. 2 is a flow chart of an example of a process of conditioning the wellbore with a reamer on a wireline.

FIG. 2 is a flow chart of an example of a process 200 of conditioning the wellbore with a reamer on a wireline. The process 200 can be implemented in part by the features described earlier and in part by a well operator. At 202, a portion of the wellbore is formed with a wellbore drilling assembly. At 204, a wellbore tool, with a wellbore sampling tool and a reamer on a wireline, is lowered into the portion of the wellbore. At 206, without rotating the wellbore sampling tool, the reamer is operated to ream the portion of the wellbore. At 208, after reaming the wellbore, the well data is sampled using the wellbore sampling tool. In particular, the wellbore sampling tool is implemented while the reamer remains within the wellbore. In this manner, by mounting the wellbore sampling tool and the reamer to the same wireline, an extra trip to remove the reamer and then lower the wellbore sampling tool is avoided.

Thus, particular implementations of the subject matter have been described. Other implementations are within the scope of the following claims.

The invention claimed is:

1. A method comprising:

forming, using a wellbore drilling assembly, a portion of a wellbore from a surface of the Earth toward a subsurface hydrocarbon reservoir;

after forming the portion of the wellbore, removing the wellbore drilling assembly from the portion of the wellbore;

lowering, using a wireline, a wellbore sampling tool and a reamer into the portion of the wellbore; and while maintaining the wellbore sampling tool and the wireline in a non-rotational state, reciprocating the wireline within the portion of the wellbore, and reaming, using the reamer, the portion of the wellbore, wherein the reamer reams the portion of the wellbore responsive to reciprocating the wireline.

2. The method of claim 1, wherein maintaining the wellbore sampling tool and the wireline in a non-rotational state comprises not rotating the wellbore sampling tool and the wireline within the portion of the wellbore.

3. The method of claim 1, wherein reciprocating the wireline within the portion of the wellbore comprises causing the reamer to alternatingly travel uphole and downhole within the portion of the wellbore.

4. The method of claim 1, wherein the reamer comprises a plurality of reaming pads on an outer surface of the reamer, the plurality of reaming pads configured to contact an inner wall of the portion of the wellbore, wherein reaming, using the reamer, the portion of the wellbore comprises causing the plurality of reaming pads to contact the inner wall of the portion of the wellbore.

5. The method of claim 4, wherein the plurality of reaming pads are in a retracted state when lowering, using the wireline, the wellbore sampling tool and the reamer into the portion of the wellbore, and wherein the method further comprises extending the plurality of reaming pads from the retracted state into an extended state, wherein the plurality of reaming pads contact the inner wall of the portion of the wellbore in the extended state.

6. The method of claim 5, further comprising transmitting, through the wireline, an electrical signal from the surface of the Earth to the reamer, wherein, responsive to the electrical signal, the reamer extends the plurality of reaming pads from the retracted state into the extended state.

7. The method of claim 6, further comprising a hydraulic fluid reservoir attached to the reamer, wherein, responsive to the electrical signal, hydraulic fluid in the hydraulic fluid reservoir is flowed to the plurality of reaming pads to extend the plurality of reaming pads from the retracted state into the extended state.

8. The method of claim 7, further comprising a hydraulic piston attached to each reaming pad of the plurality of reaming pads and to the hydraulic fluid reservoir, wherein flowing the hydraulic fluid to each reaming pad causes the corresponding hydraulic piston to extend.

9. The method of claim 1, wherein, responsive to reciprocating the wireline, the reamer reams the portion of the wellbore without rotating within the portion of the wellbore.

10. The method of claim 1, wherein, responsive to reciprocating the wireline, the reamer rotates about a longitudinal axis of the wellbore to ream the portion of the wellbore.

11. The method of claim 10, wherein the reamer is connected to the wireline using one or more wireline swivels, wherein the one or more wireline swivels cause the reamer to rotate about the longitudinal axis of the wellbore responsive to reciprocating the wireline within the portion of the wellbore.

12. The method of claim 1, further comprising, after reaming the portion of the wellbore, operating the wellbore sampling tool to sample data associated with the wellbore.

13. A method comprising:

after forming a portion of a wellbore from a surface of the Earth toward a subsurface hydrocarbon reservoir, lowering, using a wireline, a well tool assembly comprising a wellbore sampling tool and a reamer into the portion of the wellbore, the reamer attached to the wireline downhole of the wellbore sampling tool;

without rotating the wireline or the wellbore sampling tool, reciprocating the wireline within the portion of the wellbore, and reaming, using the reamer, the portion of the wellbore, wherein the reamer reams the portion of the wellbore responsive to reciprocating the wireline; and after reaming the portion of the wellbore, sampling data associated with the wellbore using the wellbore sampling tool.

14. The method of claim 13, wherein reciprocating the wireline within the portion of the wellbore comprises causing the reamer to alternatingly travel uphole and downhole within the portion of the wellbore.

15. A method comprising:

after forming a portion of a wellbore from a surface of the Earth toward a subsurface hydrocarbon reservoir, lowering, using a wireline, a well tool assembly comprising a wellbore sampling tool and a reamer into the portion of the wellbore, the reamer attached to the wireline downhole of the wellbore sampling tool;

without rotating the wireline or the wellbore sampling tool, reaming, using the reamer, the portion of the wellbore comprises reciprocating the wireline within the portion of the wellbore, wherein the reamer reams the portion of the wellbore, responsive to reciprocating the wireline, without rotating within the portion of the wellbore; and after reaming the portion of the wellbore, sampling data associated with the wellbore using the wellbore sampling tool.

16. The method of claim 15, wherein reciprocating the wireline within the portion of the wellbore comprises causing the reamer to alternatingly travel uphole and downhole within the portion of the wellbore.

17. The method of claim 15, wherein the wellbore tool assembly comprises a wireline swivel that connects the reamer to the wireline, wherein the reamer rotates about the swivel responsive to reciprocating the wireline.

18. A method comprising:

after forming a portion of a wellbore from a surface of the Earth toward a subsurface hydrocarbon reservoir, lowering, using a wireline, a well tool assembly comprising a wellbore sampling tool and a reamer into the portion of the wellbore, the reamer attached to the wireline downhole of the wellbore sampling tool;

without rotating the wireline or the wellbore sampling tool, reaming, using the reamer, the portion of the wellbore comprises reciprocating the wireline within the portion of the wellbore, wherein responsive to reciprocating the wireline, the reamer rotates about a longitudinal axis of the wellbore to ream the portion of the wellbore; and after reaming the portion of the wellbore, sampling data associated with the wellbore using the wellbore sampling tool.

19. The method of claim 18, wherein the wellbore tool assembly comprises a wireline swivel that connects the reamer to the wireline, wherein the reamer rotates about the swivel responsive to reciprocating the wireline.

20. The method of claim 18, wherein reciprocating the wireline within the portion of the wellbore comprises causing the reamer to alternatingly travel uphole and downhole within the portion of the wellbore.

21. A method comprising:

after forming a portion of a wellbore from a surface of the Earth toward a subsurface hydrocarbon reservoir, lowering, using a wireline, a well tool assembly comprising a wellbore sampling tool and a reamer into the portion of the wellbore, the reamer attached to the wireline downhole of the wellbore sampling tool, wherein the reamer is in a retracted state when the well tool assembly is lowered into the portion of the wellbore, wherein, in the retracted state, the reamer does not contact an inner wall of the portion of the wellbore, wherein the method further comprises:

transmitting, from the surface of the Earth and through the wireline, an electrical signal to the reamer; and responsive to the electrical signal, transforming the reamer to an extended state, wherein, in the extended state, the reamer contacts the inner wall of the portion of the wellbore;

without rotating the wireline or the wellbore sampling tool, reaming, using the reamer, the portion of the wellbore comprises reciprocating the wireline within the portion of the wellbore, wherein the reamer reams the portion of the wellbore responsive to reciprocating the wireline; and after reaming the portion of the wellbore, sampling data associated with the wellbore using the wellbore sampling tool.

22. The method of claim 21, wherein reciprocating the wireline within the portion of the wellbore comprises causing the reamer to alternatingly travel uphole and downhole within the portion of the wellbore.

23. The method of claim 21, wherein the wellbore tool assembly comprises a wireline swivel that connects the reamer to the wireline, wherein the reamer rotates about the swivel responsive to reciprocating the wireline.

* * * * *